US007981260B2

(12) United States Patent
Huber et al.

(10) Patent No.: US 7,981,260 B2
(45) Date of Patent: Jul. 19, 2011

(54) ELECTROLYSIS CELL FOR PRODUCING ALKALI METAL

(75) Inventors: Guenther Huber, Ludwigshafen (DE); Reinhard Oettl, Ludwigshafen (DE); Manfred Munzinger, Dirmstein (DE); Heinz Neumann, Mannheim (DE); Martina Schulz, Eisenberg (DE); Matthias Stahl, Altrip (DE); Gerhard Ruf, Frankenthal (DE); Ralph Hamleser, Waldsee (DE); Hans-Juergen Bender, Freinsheim (DE); Volker Esswein, Germersheim (DE)

(73) Assignee: BASF Aktiengesellschaft, Ludwigshafen (DE)

( * ) Notice: Subject to any disclaimer, the term of this patent is extended or adjusted under 35 U.S.C. 154(b) by 1161 days.

(21) Appl. No.: 11/575,219

(22) PCT Filed: Sep. 12, 2005

(86) PCT No.: PCT/EP2005/009786

§ 371 (c)(1), (2), (4) Date: Mar. 14, 2007

(87) PCT Pub. No.: WO2006/029792

PCT Pub. Date: Mar. 23, 2006

(65) Prior Publication Data

US 2007/0246368 A1 Oct. 25, 2007

(30) Foreign Application Priority Data

Sep. 14, 2004 (DE) ..... 10 2004 044 405

(51) Int. Cl.
*C25D 17/00* (2006.01)
*C25B 9/14* (2006.01)

(52) U.S. Cl. ..... 204/251; 204/194; 204/219; 204/242; 204/245

(58) Field of Classification Search ..... 204/251, 204/194, 242, 245, 219
See application file for complete search history.

(56) References Cited

U.S. PATENT DOCUMENTS 4,089,770 A * 5/1978 Lemke ..... 204/247

FOREIGN PATENT DOCUMENTS

| | | |
|---|---|---|
| DE | 1 114 330 | 9/1961 |
| EP | 1 114 883 | 7/2001 |
| GB | 1 155 927 | 6/1969 |

* cited by examiner

*Primary Examiner* — Harry D Wilkins, III
*Assistant Examiner* — Zulmariam Mendez
(74) *Attorney, Agent, or Firm* — Oblon, Spivak, McClelland, Maier & Neustadt, L.L.P.

(57) ABSTRACT

An electrolysis cell for preparing alkali metals from a liquid alkali metal heavy metal alloy, including a tube arranged essentially horizontally having a closure device at each of the two ends of the tube. At least one solid electrolyte tube arranged concentrically in the tube and oriented with openings towards one end of the tube such that a first annular gap for conducting a liquid alkali metal, which forms an anode, is present between the inside of the tube and the outside of the solid electrolyte tube. An interior space in the solid electrolyte tube, sealed off from an alloy inlet, first annular gap and an alloy outlet, accommodates liquid alkali metal that can be used as a cathode.

20 Claims, 2 Drawing Sheets

ELECTROLYSIS CELL FOR PRODUCING ALKALI METAL

Figure 1:
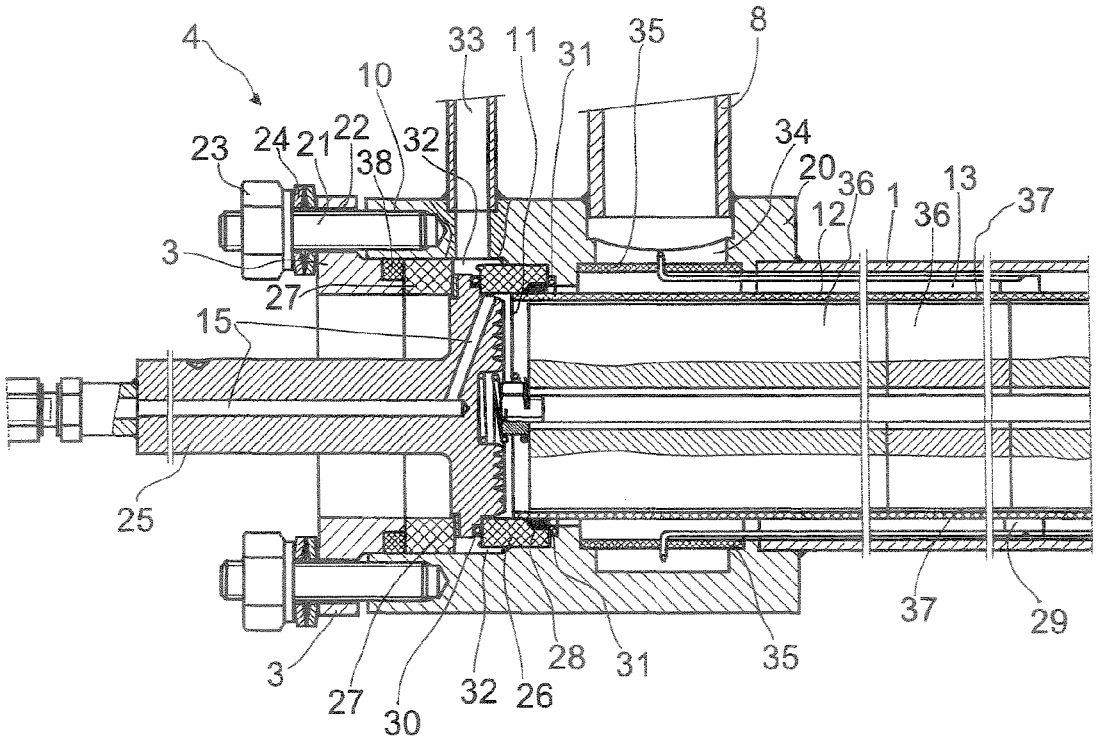

The present invention relates to an electrolysis cell for preparing liquid alkali metal from a liquid alkali metal-heavy metal alloy.

For the purposes of the present invention, an alkali metal is, in particular, sodium, potassium or lithium.

Sodium is an important basic inorganic product which is used, inter alia, for preparing sodium compounds such as sodium peroxide, sodium hydride, sodium boranate and sodium amide, for obtaining titanium by a metallothermic process and for reductive purposes in the organic chemical industry, for purifying hydrocarbons and waste oil, for condensations, for the preparation of alkoxides, as polymerization catalyst and in preparative organic chemistry. Sodium is nowadays usually prepared by melt electrolysis of a ternary mixture of NaCl, $CaCl_2$ and $BaCl_2$ in the Downs process.

Lithium is used, inter alia, in nuclear technology for the preparation of tritium, as alloying addition to aluminum, lead or magnesium, in organic syntheses, for the synthesis of complexing metal hydrides, for preparing organometallic compounds, for condensations, dehydrohalogenations, for preparing ternary amines or quaternary ammonium salts, in the mineral oil industry as catalyst and for desulfurization, for the polymerization of isoprene to cis-polymers, in the ceramics industry for regulating the coefficient of expansion, lowering the melting point and the like, for producing lubricants, as antioxidant and purification agent in the metallurgy of iron, nickel, copper and alloys thereof. Lithium is, in the prior art, likewise prepared on an industrial scale by electrolysis of anhydrous alkali metal chloride melts in the Downs process, with the melting points of the salt melts being reduced by addition of alkali metal chlorides.

In the case of the two metals sodium and lithium, the operating life of known electrolysis cells is restricted to 2-3 years. Interruption of the power supply or shutdown of the cell generally leads to destruction of the cell. The sodium obtained by the Downs process has, due to the additives to the melt, the disadvantage that it is contaminated primarily with calcium. Although the residual calcium context can be reduced by subsequent purification steps, it can never be removed completely. In the case of the lithium obtained by the Downs process, a significant disadvantage is that the aqueous lithium chloride solutions obtained in the chemical reaction of lithium firstly have to be worked up to produce anhydrous lithium chloride before use in the electrolysis.

Potassium is likewise an important basic inorganic product which is used, for example, for the preparation of potassium alkoxides, potassium amides and potassium alloys. It is nowadays prepared industrially primarily by reduction of potassium chloride by sodium in reactive distillation. A disadvantage is that the process operates at high temperatures. In addition, the potassium formed contains about 1% of sodium as impurity and therefore has to be purified by a further rectification. The great disadvantage is that the sodium used is expensive. This is because sodium is obtained industrially by electrolysis of molten sodium chloride in the Downs process, which requires a high energy input.

Alkali metal amalgams are obtained in large quantities as intermediate in chloralkali electrolysis by the amalgam method and generally reacted with water to form alkali metal hydroxide solutions and then recirculated in the closed circuit to the chloralkali electrolysis.

GB 1,155,927 describes a process in which sodium metal can be obtained by electrochemical means using a solid sodium ion conductor with amalgam as anode and sodium as cathode. However, repetition of the method described in GB 1,155,927 does not lead to the results described there in respect of sodium conversion, product purity and current density. Furthermore, the system described becomes unstable over the course of a few days when the claimed temperature range is adhered to.

EP 1 114 883 A1 describes the preparation of an alkali metal from alkali metal amalgam in a process which is improved compared to the process described in GB 1,155,927. In this process, the preparation is carried out by electrolysis using anode comprising alkali metal amalgam, a solid electrolyte which conducts alkali metal ions and liquid alkali metal as cathode, with the alkali metal amalgam used as anode being kept in motion. The electrolysis is carried out in an electrolysis cell comprising a tubular solid electrolyte which is closed at one end and is installed in a concentric stainless steel tube so as to form an annular gap. This process carried out in this electrolysis cell has the following advantages over the above-described prior art, in particular over the preparation of alkali metals by the Downs process:

- The cell allows a process having a 40% lower energy consumption including the preliminary stage due to the higher current yield resulting from the reduced backreaction and the low cell voltage.
- The cell has no limitations to its life resulting from the process.
- Part load operation or interruption of production are possible.
- Only liquid materials which are easy to meter are used and produced.
- The salts are used as aqueous solutions in the preliminary stage of the process described.
- The apparatus operates fully automatically.
- Highly pure alkali metals are produced.
- No additional purification steps are necessary.

It was an object of the present invention to provide an electrolysis cell which is based on the process described in EP 1 114 883 A1 and the apparatus disclosed therein and in which components in which alkali metal-heavy metal alloy is present and components in which alkali metal is present are separated effectively. A further object of the present invention was to make inexpensive and unproblematical maintenance of the electrolysis cell possible.

This object is achieved according to the invention by an electrolysis cell for preparing liquid alkali metal from a liquid alkali metal-heavy metal alloy, which comprises

- a tube which is arranged essentially horizontally and has a closure device at each of the two ends of the tube,
- at least one solid electrolyte tube arranged in the tube, which conducts alkali metal ions and is closed at one end and has an opening at the other end, with the solid electrolyte tube being arranged concentrically in the tube and having the opening facing one end of the tube so that a first annular gap for conducting the liquid alkali metal-heavy metal alloy which forms one anode is present between the inside of the tube and the outside of the solid electrolyte tube,
- an interior space in the solid electrolyte tube for accommodating the liquid alkali metal which can be utilized as cathode, where the closure device comprises an alkali metal-heavy metal alloy inlet or outlet opening into the first annular gap, a holder for the solid electrolyte tube, an alkali metal outlet connected to the interior space of the solid electrolyte tube and a sealing system for sealing the interior space of the solid electrolyte tube and the alkali metal outlet off from the first annular gap, the alkali metal-heavy metal alloy inlet or outlet and from the surroundings of the electrolysis cell.

The electrolysis cell of the invention allows operation of the electrolysis on an industrial scale. The closure device performs a number of functions, so that a simple construction of the electrolysis cell is achieved. The electrolysis cell of the invention is intended for continuous operation. The flow of the liquid alkali metal-heavy metal alloy is preferably driven by a pump located outside the electrolysis cell. The essentially horizontal tube together with the solid electrolyte tube pushed into it forms the reaction module in which the electrolysis takes place. The construction according to the invention of the electrolysis cell ensures that the alkali metal-heavy metal alloy is conveyed so that transport of the alkali metal dissolved in the heavy metal to the surface of the solid electrolyte which conducts alkali metal ions is ensured for the high current densities of industrial production.

Furthermore, appropriate selection of materials for the construction of the electrolysis cell of the invention makes it possible to achieve a long operating life as is customary for apparatuses in industrial chemistry. The electrolysis in the cell of the invention can be interrupted at any time without damaging the cell.

Liquid alkali metal-heavy metal alloy, in particular an alkali metal amalgam containing sodium, potassium or lithium as alkali metal, is fed into the cell of the invention. Further possible heavy metals as constituent of the liquid alkali metal-heavy metal alloy are gallium or lead or alloys of gallium, lead and mercury. To keep sodium amalgam in liquid form, the sodium concentration of this solution has to be less than 1% by weight, preferably from 0.2 to 0.5% by weight. To keep potassium amalgam in liquid form, the potassium concentration of this solution is less than 1.5% by weight, preferably 0.3 to 0.6% by weight. To keep lithium amalgam in liquid form, the lithium concentration of this solution is less than 0.19% by weight, preferably from 0.02 to 0.06% by weight.

The material selected for the essentially horizontal tube is preferably stainless steel or graphite. As materials for the solid electrolyte tube, ceramic materials used in sodium production, e.g. Nasicon® whose composition is given in EP-A 0 553 400, are possible.

Glasses which conduct sodium ions and also zeolites and feldspars are also suitable. In the preparation of potassium, a large number of materials can likewise be used. Both the use of ceramics and the use of glasses are possible. For example, the following materials are suitable: $KBiO_3$, gallium oxide-titanium dioxide-potassium oxide systems, aluminum oxide-titanium dioxide-potassium oxide systems and Kasicon® glasses. However, preference is given to sodium-β-aluminum oxide, sodium-β-aluminum oxide and sodium-β/β"-aluminum oxide or potassium-β"-aluminum oxide, potassium-β-aluminum oxide and potassium-β/β"-aluminum oxide. Potassium-β"-aluminum oxide, potassium-β-aluminum oxide and potassium-β/β"-aluminum oxide can be prepared from sodium-β"-aluminum oxide, sodium-β-aluminum oxide and sodium-β/β"-aluminum oxide, respectively, by cation exchange. In the preparation of lithium, a large number of materials can likewise be used. For example, the following materials are possible: $Li_{4-x}Si_{1-x}P_xO_4$, Li-beta"-$Al_2O_3$, Li-beta-$Al_2O_3$, lithium analogues of Nasicon® ceramics, lithium ion conductors having a perovskite structure and sulfidic glasses as lithium ion conductors.

The solid electrolyte tube is closed at one end and are preferably thin-walled but pressure-resistant and designed with a circular cross section.

The tube has a length of from 0.5 m to 2 m, preferably from 0.9 m to 1.1 m. The internal diameter of the tube is from 35 mm to 130 mm, preferably from 65 mm to 75 mm. The tube thickness (wall thickness) is from 1 mm to 30 mm, preferably from 2.5 mm to 3.6 mm, when commercial, welded tubes are used and preferably from 15 to 20 mm when the tube has been produced by casting.

The solid electrolyte tube has an external diameter of from 30 mm to 100 mm, preferably from 55 mm to 65 mm. The wall thickness of the solid electrolyte tube is from 0.9 mm to 2.5 mm, preferably from 1.2 mm to 1.8 mm. They have a length of from 20 cm to 75 cm, preferably from 45 cm to 55 cm.

This gives a gap width of the first annular gap of from 2.35 mm to 15 mm, preferably from 4.5 mm to 5.5 mm.

The alkali metal-heavy metal alloy enters the first annular gap surrounding the solid electrolyte tube via the alkali metal-heavy metal alloy inlet. From there, the alkali metal-heavy metal alloy flows through the first annular gap of the tube and finally flows out of the tube via the alkali metal-heavy metal alloy outlet. The electrolysis is operated by applying an electric potential between the outside of the solid electrolyte tube which comprise a solid electrolyte which conducts alkali metal ions and are closed at one end and the inside, so that the alkali metal-heavy metal alloy flowing outside in a longitudinal direction in the first annular gap forms the positive pole and the alkali metal formed inside forms the negative pole. The potential difference produces an electric current which leads to alkali metal being oxidized at the interface between alkali metal-heavy metal alloy and ion conductor, the alkali metal ion then being transported through the ion conductor and then being reduced back to metal at the interface between ion conductor and alkali metal in the interior of the solid electrolyte tube. During the electrolysis, the alkali metal-heavy metal alloy stream is thus continuously depleted in alkali metal in proportion to the electric current which flows. The alkali metal transferred in this way to the inside of the solid electrolyte tube can be discharged continuously from there via the alkali metal outlet. The electrolysis is carried out at a temperature in the range from 260 to 400° C. In the case of the electrolysis of an alkali metal amalgam, the temperature should be below the boiling point of mercury, preferably at from 310° C. to 325° C. when the alkali metal is sodium and at from 265° C. to 280° C. when the alkali metal is potassium and at from 300° C. to 320° C. when the alkali metal is lithium.

The alkali metal-heavy metal alloy is preferably preheated to from 200° C. to 320° C., preferably from 250° C. to 280° C., before being fed to the electrolysis cell of the invention. For this purpose, the electrolysis cell can be provided with a heat exchanger, in particular a countercurrent heat exchanger, so that the hot alkali metal-heavy metal alloy depleted in alkali metal which leaves the tube of the electrolysis cell heats the alkali metal-heavy metal alloy feed to the tube. However, it is also possible to preheat the alkali metal-heavy metal alloy by means of heating wires wound around the feed line.

At the two end faces of the essentially horizontal tube there is in each case a closure device which is suitable for in each case accommodating a solid electrolyte tube which is closed at one end and comprises a solid electrolyte which conducts alkali metal ions. The opening of the solid electrolyte tube is directed outward. The closure device is configured in terms of the seals so that the space filled with alkali metal-heavy metal alloy ion in the essentially horizontal tubes is sealed off in a leakage-free manner both from the environment and from the interior of the solid electrolyte tube. Furthermore, the closure device also seals the interior space of the solid electrolyte tube against the environment. It comprises a sealing system for sealing the interior space of the solid electrolyte tube and the alkali metal outlet off from the first annular gap, the alkali metal-heavy metal alloy inlet or outlet and from the surroundings of the electrolysis cell.

In a preferred embodiment of the present invention, the closure device has a part which is fixed to the tube and a demountable part, with the part of the closure device which is fixed to the tube being bonded to the tube or constructed in one piece with it. As a result of the closure device having a demountable part, access to the components of the electrolysis cell located in the tube is made possible, in particular for the purposes of repair, replacement or maintenance. In a preferred embodiment of the electrolysis cell of the invention, the demountable part of the closure device has a T-piece containing the alkali metal outlet. Molten alkali metal can be taken off from the interior space of the solid electrolyte tube via the alkali metal outlet. The T-piece is preferably made of an electrically conductive material, so that it can be used as an electric connection for the cathode.

In a preferred embodiment of the present invention, a first insulation ring and a second insulation ring are arranged in the closure device so that they electrically insulate the T-piece from other electrically conductive parts of the closure device. Thus, if the T-piece is utilized as an electric connection for the cathode, it is electrically insulated from the electrically conductive parts of the electrolysis cell which are connected to the anode, for example electrically insulated from the tube so that a short circuit is avoided. The insulation rings preferably consist of a ceramic material which is not electrically conductive. In particular they comprise sintered $Al_2O_3$, $ZrO_2$, magnesium oxide or boron nitride.

The sealing system present in the closure device preferably has two sealing rings in contact with the two sides of the first insulation ring. These are, for example, commercial gasket rings made of flexible graphite sheets reinforced with stainless steel foils, for example SIGRAFLEX®. In principle, it is possible to use all seals which are suitable in terms of heat resistance and chemical resistance. A further example of sealing rings which can be used is laminated mica seals such as KLINGERmilam®.

In a preferred embodiment of the present invention, an annular space for conveying an inert gas introduced under pressure, in particular nitrogen, is located between the two sealing rings next to the first insulation ring. The sealing system of the electrolysis cell is in this way made particularly reliable. The inert gas is introduced under pressure into the annular space. Neither alkali metal-heavy metal alloy via the one sealing ring nor alkali metal via the other sealing ring can be pressed into the annular space if the pressure of the inert gas is set to a sufficiently high value. The inert gas is preferably introduced at a higher pressure than the counterpressure to be expected on the alkali metal-heavy metal alloy side or on the alkali metal side. If the sealing rings do not seal sufficiently well, inert gas gets into the alkali metal-heavy metal alloy or the alkali metal, which does not result in any negative consequences. Without this annular space containing inert gas between the two sealing rings, alkali metal-heavy metal alloy or alkali metal leaking out could cause an electric short circuit between anode and cathode. Furthermore, this measure prevents, for example, mercury vapor in the case of an amalgam as alkali metal-heavy metal alloy from permeating via the sealing rings into the alkali metal.

In a preferred embodiment of the electrolysis cell of the invention, a displacement body is arranged in the interior of the solid electrolyte tube so that there is a second annular gap for accommodating liquid alkali metal between the outside of the displacement body and the inside of the solid electrolyte tube. The displacement body reduces the volume in the interior of the solid electrolyte tube which can be filled with alkali metal. This has the advantage that at any point in time only a small amount of alkali metal is present in the solid electrolyte tube so that if the solid electrolyte tube fails suddenly, only this small amount can come into contact with the alkali metal-heavy metal alloy surrounding the solid electrolyte tube. The energy potential of the backreaction is thereby kept as small as possible. The displacement body can be a solid metal body. This metal body has the further advantage that it can be used as cathode if the electrolysis is started using a solid electrolyte tube which is not yet filled with alkali metal. However, a closed hollow body can also serve as displacement body. This hollow body has the advantage that, owing to its low weight, it can be more easily pushed into the solid electrolyte tube without damaging the latter. Furthermore, a thin-walled metal tube which is closed at one end is not precisely fitted to the shape of the interior of the solid electrolyte tube and is introduced into the solid electrolyte tube so that a very narrow second annular gap is formed can also serve as displacement body. A further body can be introduced as reinforcement into the thin-walled metal tube. The displacement body configured as a thin-walled metal tube has the advantage that the amount of alkali metal which is mixed with alkali metal-heavy metal alloy in the event of failure of the solid electrolyte tube is very small.

Two solid electrolyte tubes which each have their opening directed toward an end of the tube are preferably arranged in the tube.

Furthermore, the invention provides an electrolysis apparatus having a multiplicity of electrolysis cells which are connected to one another in such a way that the liquid alkali metal-heavy metal alloy is conducted as a meandering stream through the electrolysis cells. The electrolysis apparatus of the invention has the advantage that it has a modular construction. At least two superposed cells are connected to form an electrolysis unit through which a stream of alkali metal-heavy metal alloy flows from the first to the last tube. The number of electrolysis cells can be increased at will. Likewise, the number of electrolysis units used in parallel can be increased at will. This makes preparation of alkali metals on an industrial scale possible.

The electrolysis apparatus of the invention preferably has from 2 to 100 tubes, particularly preferably from 5 to 25 tubes, per electrolysis unit. It comprises n parallel electrolysis units, where n is preferably from 1 to 100, particularly preferably from 5 to 20.

The invention further provides for the use of an electrolysis cell of the invention for preparing sodium, potassium or lithium from a liquid alkali metal amalgam.

DRAWING

The invention is illustrated below with the aid of the drawing.

Figure 2:
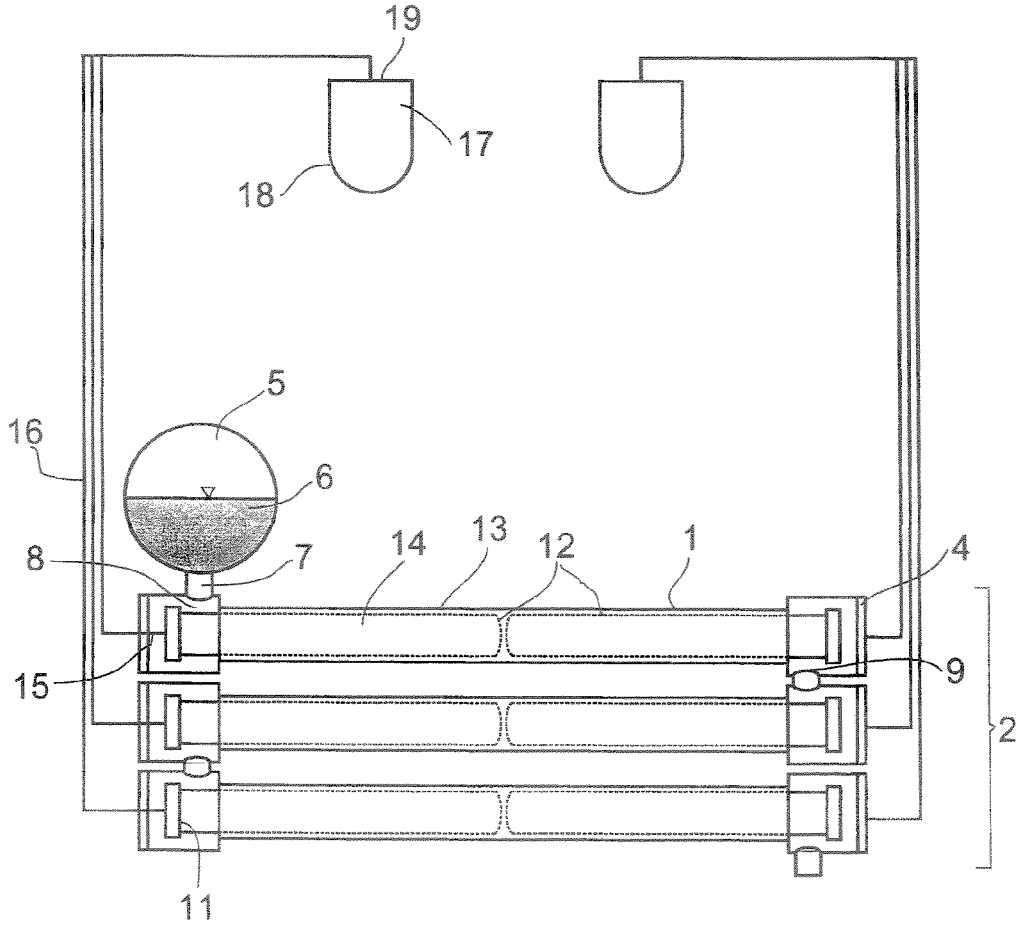

In the drawing:

FIG. 1 shows a section of an electrolysis cell according to the invention and FIG. 2 schematically shows an electrolysis apparatus according to the invention.

PARTICULAR EMBODIMENTS

FIG. 1 shows a section of an electrolysis cell of the invention for preparing liquid alkali metal from a liquid alkali metal-heavy metal alloy.

The electrolysis cell comprises an essentially horizontal tube 1. FIG. 1 depicts only one end of the tube 1 with a closure device 4. However, the electrolysis cell of the invention has a largely symmetrical construction with a further closure device 4 (not shown) at the other end of the tube 1. A solid electrolyte tube 12 is arranged concentrically in the tube and is closed at one end (not shown) and has an opening 11 at the other end (shown). The opening 11 is directed toward the end of the tube 1. Between the inside of the tube 1 and the outside of the solid electrolyte tube 12 there is a first annular gap 13 for conducting the liquid alkali metal-heavy metal alloy which forms one anode and which travels through the alkali metal-heavy metal alloy inlet 8 into the tube 1 and flows along the first annular gap 13 around the solid electrolyte tube 12 to an alkali metal-heavy metal alloy outlet 9 (not shown) at the other end of the tube 1. The interior space 14 of the solid electrolyte tube 12 serves to accommodate liquid alkali-metal which is formed there during the electrolysis and can be utilized as cathode of the electrolysis cell.

Not only the alkali metal-heavy metal alloy inlet 8 or alkali metal-heavy metal alloy outlet 9, but also a holder for the solid electrolyte 12, an alkali metal outlet 15 connected to the interior space 14 of the solid electrolyte tube 12 and a sealing system are integrated into the respective closure device 4. The closure device 4 comprises a part 20 which is fixed to the tube 1 and a demountable part, with the part 20 of the closure device 4 which is fixed to the tube 1 being bonded to the tube 1.

The demountable part of the closure device 4 can be fastened by means of a clamping ring 3 to the part 20 of the closure device 4 which is fixed to the tube 1. The clamping ring 3 can be clamped firmly onto the closure device 4 by means of two threaded bolts 21 which are each screwed into a threaded hole 10 in the part 20 of the closure device 4 which is fixed to the tube 1 and each extend through a drilled hole 22 in the clamping ring 3 and by means of a nut 23 and a spring washer 24.

The demountable part of the closure device 4 has a T-piece 25 containing the alkali metal outlet 15. The T-piece 25 is preferably made of an electrically conductive material so that it can be used as an electric connection for the cathode. It provides a direct electrical contact with the alkali metal formed in the interior space electrolysis.

In the preferred embodiment of the present invention shown in FIG. 1, a first insulation ring 26 and a second insulation ring 27 are arranged in the closure device 4 so that they electrically insulate the T-pieces 25 from other electrically conductive parts of the closure device 4. The first insulation ring 26 is connected to the end of the solid electrolyte tube 12 having the opening 11 by means of an adhesive 28 which is not electrically conductive. The adhesive 28 is preferably a glass.

The demountable part of the closure device 4 comprises not only the clamping ring 3 and the T-piece 25 but also the second insulation ring 27. In the clamped state, the clamping ring 3 presses the second insulation ring 27, the T-piece 25 and the first insulation ring 26 against the part 20 of the closure device 4 which is fixed to the tube 1. These components thus form a holder for the solid electrolyte tube 12 which is held in place firmly by the pressure on the part 20 of the closure device 4 which is fixed to the tube 1 by means of its attached first insulation ring 26. A further sealing ring 38 is located between the clamping ring 3 and the second insulation ring 27. The electrolysis cell of the invention further comprises a springy support device 29 which facilitates the concentric installation of the ion-conducting solid electrolyte tube 12 in the tube 1 and partly takes up the gravitational forces in the empty state and the buoyancy force in the filled state of the interior space 14 of the solid electrolyte tube 12.

The sealing system of the closure device 4 has two sealing rings 30, 31 in contact with the two sides of the first insulation ring 26. An annular space 32 for conveying an inert gas introduced under pressure is located between the two sealing rings, 30, 31 next to the first insulation ring 26. The inert gas is introduced under pressure into the annular space 32 via a gas line 33.

The alkali metal-heavy metal alloy inlet 8 or outlet 9 is connected to the part 20 of the closure device 4 which is fixed to the tube 1. FIG. 1 depicts an alkali metal-heavy metal alloy inlet 8 via which the alkali metal-heavy metal alloy flows into an annular alloy space 34 which is separated from the first annular gap 13 by a circumferential screen 35. This construction is advantageous for distributing the alkali metal-heavy metal alloy flow over the cross section of the first annular gap 13 serving as reaction zone. Furthermore, this arrangement prevents troublesome solid particles from getting into the reaction zone and leading to blockages there.

The interior space 14 of the solid electrolyte tube 12 is filled virtually completely by a displacement body 36 so that merely a second annular gap 37 remains free for the resultant alkali metal between the outside of the displacement body 36 and the inside of the solid electrolyte tube 12.

FIG. 2 shows a schematic depiction of an electrolysis apparatus according to the invention.

The electrolysis apparatus has a multiplicity of tubes 1 which form an electrolysis unit 2. Three superposed tubes 1 are shown in electrolysis unit 2. Two solid electrolyte tubes 12 which are closed at one end and have an opening 11 at the other end are present in each tube 1. The solid electrolyte tubes 12 are arranged concentrically in the tube 1 and have their opening 11 in each case directed toward one end of the tube 1. Between the inside of the tube 1 and the outside of the solid electrolyte tubes 12 there is a first annular gap 13 for conducting the liquid alkali metal-heavy metal alloy 6 which forms one anode and travels from the alloy distributor 5 via the outlet piece 7 and the alkali metal-heavy metal alloy inlet 8 into the uppermost tube 1 and flows along the annular gap 13 around the solid electrolyte tubes 12 to the alkali metal-heavy metal alloy outlet 9 and from there into the next tube 1 below. Due to the depicted arrangement of the electrolysis apparatus of the invention, the alkali metal-heavy metal alloy is conducted as a meandering stream through the electrolysis unit 2. Each closure device 4 serves as holder for a solid electrolyte tube 12 which is detachable, so that a defective solid electrolyte tube 12 can be replaced without problems. The interior space 14 of the solid electrolyte tube 12 is sealed off from the parts of the electrolysis unit 2 in which alkali metal-heavy metal alloy is present, as described above for FIG. 1. The interior space 14 serves to accommodate liquid alkali metal which is formed there during the electrolysis and can be utilized as cathode of the electrolysis apparatus. The interior space 14 is connected to an alkali metal outlet 15 which conducts the alkali metal via a discharge line 16 to an alkali metal collector 17 positioned above the alloy distributor 5. The alkali metal collector 17 is preferably filled with an inert gas under superatmospheric pressure. The alkali metal collector 17 is, in the embodiment of the present invention depicted in FIG. 2, configured as a collecting channel 18 with a lid 19, with the discharge line 16 opening from the top through the lid 19 into the alkali metal collector 17. If one of the solid electrolyte tubes 12 should fail, only a small amount of alkali metal from the discharge line 6 and the interior space 14 can react with the alkali metal-heavy metal alloy in the tube 1 as a result of this construction. The alkali metal-heavy metal alloy 6 does not get into the alkali metal collector 17. A failure in the electrolysis apparatus of the invention can therefore be tolerated without the electrolysis having to be interrupted and without consequent damage or a deterioration in the quality of the alkali metal produced occurring. The electrolysis can be continued by means of the undamaged solid electrolyte tube 12.

LIST OF REFERENCE NUMERALS

1 Tube
2 Electrolysis unit
3 Clamping ring
4 Closure device
5 Alloy distributor
6 Alkali metal-heavy metal alloy
7 Outlet piece
8 Alkali metal-heavy metal alloy inlet
9 alkali metal-heavy metal alloy outlet
10 Threaded hole
11 Opening
12 Solid electrolyte tube
13 First annular gap
14 Interior space
15 Alkali metal outlet
16 Discharge line
17 Alkali metal collector
18 Collecting channel
19 Lid
20 Part of the closure device which is fixed to the tube
21 Threaded bolts
22 Drilled hole in the clamping ring
23 Nut
24 Spring washer
25 T-piece
26 First insulation ring
27 Second insulation ring
28 Adhesive which is not electrically conductive
29 Springy support device
30 First sealing ring
31 Second sealing ring
32 Annular space
33 Gas line
34 Annular alloy space
35 Circumferential screen
36 Displacement body
37 Second annular gap
38 Sealing ring

The invention claimed is:

1. An electrolysis cell for preparing a liquid alkali metal from a liquid alkali metal-heavy metal alloy, wherein the electrolysis cell comprises:

a tube which is arranged essentially horizontally and has a closure device at each of the two ends of the tube, at least one solid electrolyte tube arranged in the tube, which conducts alkali metal ions and is closed at one end and has an opening at the other end, with the solid electrolyte tube being arranged concentrically in the tube and having the opening facing one end of the tube so that a first annular gap for conducting the liquid alkali metal-heavy metal alloy which forms one anode is present between the inside of the tube and the outside of the solid electrolyte tube, and an interior space in the solid electrolyte tube for accommodating the liquid alkali metal which can be utilized as cathode, wherein the closure device comprises an alkali metal-heavy metal alloy inlet or outlet opening into the first annular gap, a holder for the solid electrolyte tube, an alkali metal outlet connected to the interior space of the solid electrolyte tube and a sealing system for sealing the interior space of the solid electrolyte tube and the alkali metal outlet off from the first annular gap, the alkali metal-heavy metal alloy inlet or outlet and from the surroundings of the electrolysis cell.

2. The electrolysis cell according to claim 1, wherein the closure device has a part which is fixed to the tube and a demountable part, with the part of the closure device which is fixed to the tube being bonded to the tube or constructed in one piece with it.

3. The electrolysis cell according to claim 2, wherein the demountable part of the closure device can be fastened by means of a clamping ring to the part of the closure device which is fixed to the tube.

4. The electrolysis cell according to claim 3, wherein the clamping ring is clamped firmly onto the closure device by at least two threaded bolts which are each screwed into a threaded hole in the part of the closure device which is fixed to the tube and each extend through a drilled hole in the clamping ring.

5. The electrolysis cell according to claim 3, wherein the demountable part of the closure device has a T-piece containing the alkali metal outlet, the T-piece being made of an electrically conductive material so that it can be used as an electric connection for the cathode.

6. The electrolysis cell according to claim 5, wherein a first insulation ring and a second insulation ring are arranged in the closure device so that they electrically insulate the T-piece from other electrically conductive parts of the closure device.

7. The electrolysis cell according to claim 6, wherein the first insulation ring is connected to the end of the solid electrolyte tube having the opening by an adhesive which is not electrically conductive.

8. The electrolysis cell according to claim 6, wherein the clamping ring in the clamped state presses the second insulation ring, the T-piece and the first insulation ring against the part of the closure device which is fixed to the tube.

9. The electrolysis cell according to claim 6, wherein the sealing system has two sealing rings in contact with the two sides of the first insulation ring, and an annular space for conveying an inert gas introduced under pressure, wherein the annular space is located between the two sealing rings next to the first insulation ring.

10. The electrolysis cell according to claim 1, wherein two solid electrolyte tubes which each have their opening directed toward an end of the tube are arranged in the tube.

11. An electrolysis apparatus comprising a multiplicity of electrolysis cells according to claim 1, where the electrolysis cells are connected to one another in such a way that the liquid alkali metal-heavy metal alloy is conducted as a meandering stream through the electrolysis cells.

12. A method for preparing a liquid alkali metal from a liquid alkali metal amalgam containing said liquid alkali metal, wherein said method comprises feeding said liquid alkali metal amalgam into the electrolysis cell according to claim 1.

13. The method according to claim 12, wherein said liquid alkali metal is liquid sodium.

14. The method according to claim 12, wherein said liquid alkali metal is liquid potassium.

15. The method according to claim 12, wherein said liquid alkali metal is liquid lithium.

16. The electrolysis cell according to claim 1, wherein said liquid alkali metal is liquid sodium.

17. The electrolysis cell according to claim 1, wherein said liquid alkali metal is liquid potassium.

18. The electrolysis cell according to claim 1, wherein said liquid alkali metal is liquid lithium.

19. The electrolysis cell according to claim 3, wherein the clamping ring is clamped firmly onto the closure device by a nut and a spring washer.

20. The electrolysis cell according to claim 9, wherein the inert gas is nitrogen.

* * * * *